US006983674B1

(12) United States Patent
Rufolo, Jr.

(10) Patent No.: US 6,983,674 B1
(45) Date of Patent: Jan. 10, 2006

(54) DEVICE AND METHOD FOR DELIVERING AN IMPACT

(76) Inventor: Joseph Rufolo, Jr., 52 King St., Clark, NJ (US) 07066

( * ) Notice: Subject to any disclaimer, the term of this patent is extended or adjusted under 35 U.S.C. 154(b) by 0 days.

(21) Appl. No.: 10/751,854

(22) Filed: Jan. 7, 2004

(51) Int. Cl.
*B25D 1/16* (2006.01)

(52) U.S. Cl. ..... 81/22; 81/20; 81/26; 81/27

(58) Field of Classification Search ..... 81/20–27
See application file for complete search history.

(56) References Cited

U.S. PATENT DOCUMENTS

| | | | | | |
|---|---|---|---|---|---|
| 911,591 | A | | 2/1909 | Hoxie | |
| 1,341,373 | A | | 5/1920 | Komatar | |
| 2,928,444 | A | * | 3/1960 | Ivins | 81/22 |
| 3,303,863 | A | * | 2/1967 | Titchnell | 81/20 |
| 3,568,657 | A | | 3/1971 | Gue | 125/40 |
| 3,601,204 | A | | 8/1971 | Denley | 173/1 |
| 4,006,763 | A | * | 2/1977 | Ordonez | 81/25 |
| 4,314,593 | A | | 2/1982 | Schwartz | 145/29 |
| 4,355,671 | A | * | 10/1982 | Senior, III | 144/195.5 |
| 4,458,415 | A | | 7/1984 | Maher et al. | 30/164 |
| 4,498,464 | A | * | 2/1985 | Morgan, Jr. | 601/107 |
| 4,785,692 | A | * | 11/1988 | Holmes | 81/27 |
| 4,831,901 | A | * | 5/1989 | Kinne | 81/25 |
| 5,109,739 | A | * | 5/1992 | Hull et al. | 81/463 |
| 5,495,878 | A | * | 3/1996 | McKenen, Jr. | 144/195.5 |
| 5,542,479 | A | * | 8/1996 | Stachler et al. | 173/90 |
| 6,052,885 | A | * | 4/2000 | Carmien | 29/428 |
| 6,128,977 | A | * | 10/2000 | Gierer et al. | 81/22 |
| 6,257,093 | B1 | * | 7/2001 | Bergacker | 81/20 |
| 6,786,491 | B2 | * | 9/2004 | Carbonneau | 279/89 |
| 2002/0178870 | A1 | * | 12/2002 | Lowther | 81/27 |
| 2004/0134312 | A1 | * | 7/2004 | Hodges | 81/27 |

FOREIGN PATENT DOCUMENTS

| | | |
|---|---|---|
| DE | 232168 | 6/1910 |

* cited by examiner

*Primary Examiner*—David B. Thomas
(74) *Attorney, Agent, or Firm*—Thomas L. Adams

(57) ABSTRACT

An impact device has a handle attached to an impact head. A weight is reciprocatably mounted on a guideway on the impact head. The weight can move along the guideway between a first position and a second position in response to motion of the head. A yielding member such as a spring or elastomeric element can be mounted at the impact head. The weight can recoil against the yielding member in response to motion of the head. The impact head can hit an object in such a manner as to move the weight in a straight line from the first position to the second position.

31 Claims, 3 Drawing Sheets

DEVICE AND METHOD FOR DELIVERING AN IMPACT

BACKGROUND OF THE INVENTION

1. Field of the Invention

The present invention relates to impacting devices and methods, and in particular, to a moving weight that provides a secondary impact.

2. Description of Related Art

Impact devices such as hammers, axes, icebreakers, scrapers, and the like deliver a blow by swinging, pushing, or otherwise thrusting the device against an object. Upon impact the kinetic energy of the device is rapidly transferred to the object for the purpose of driving a nail, fragmenting ice, splitting wood, etc. This type of impact is not always the most effective means of energy transfer.

In FIG. 1 of U.S. Pat. No. 4,314,593 when a hammer 16 strikes an object, auxiliary hammer 28 overcomes a ball detent, swings free, and impacts the back of hammer 16 causing a second impact.

German Patent 232,168 shows a sledge hammer with a hinged appendage.

In U.S. Pat. No. 1,341,373 a center punch 7/8 may be placed against a target. Trigger 30 may then be squeezed to raise hammer 23 before releasing it so that leaf spring 25 can drive hammer 23 against anvil 9.

In FIG. 2 of U.S. Pat. No. 4,458,415 a hammer 15 can slide along rod 14 to deliver an impact against stop 17 and thereby deliver a blow through ice-chopping blade 12. In the embodiment of FIG. 3, when hammer 15*a* strikes stop 17, spring-biased auxiliary hammer 22 continues to travel and provides a second impact. This reference describes using the device for chopping ice, cutting through asphalt, or for tools for stripping worn shingles from a roof. See also U.S. Pat. No. 3,568,657.

In U.S. Pat. No. 3,601,204 a steel ball 23 initially rests in conical seat 14 until the housing arm (mounted on pivot 26) hits extension 27. Thereafter ball 23 hits the inside end of rod 18, which in turn impacts the type palette 32.

In U.S. Pat. No. 911,591 a projectile is shown making an initial impact in FIG. 5 followed by a secondary impact from ball J.

Accordingly, there is a need for an improved impact device that is able to transfer energy in a more effective way.

SUMMARY OF THE INVENTION

In accordance with the illustrative embodiments demonstrating features and advantages of the present invention, there is provided an impact device including a handle attached to an impact head that has a guideway. A weight is reciprocatably mounted on the head and can move along the guideway between a first position and a second position in response to motion of the head.

In accordance with another aspect of the invention, there is provided an impact device including an impact head attached to a handle. A weight is mounted on the head to reciprocate between a first position and a second position in response to motion of the head. Also included is a yielding member mounted at the impact head. The weight can recoil against the yielding member in response to motion of the head.

In accordance with yet another aspect of the invention, a method is provided for impacting an object through the use of a weight reciprocatably mounted on an impact head. The method includes the step of moving the impact head to bring the weight to a first position. Another step is hitting the object with the impact head in a manner to move the weight in a straight line from the first position to a second position.

In accordance with still yet another aspect of the invention, a method is provided for impacting an object through the use of a yielding member and a weight reciprocatably mounted on an impact head. The method includes the step of moving the impact head to bring the weight to a first position. Another step is hitting the object with the impact head in a manner to move the weight to a second position. The weight recoils against the yielding member at either the first position or the second position.

By employing apparatus and methods of the foregoing type, an improved impact technique is achieved. In one preferred embodiment, a hammer, axe and the like have an annular weight slidably mounted on a shaft that acts as a guideway. In one embodiment an optional helical compression spring is fitted on a guideway shaft behind the sliding annular weight. With this arrangement a user can rhythmically swing a hammer so the sliding annular weight will retract at the start of the forward motion, rebound off the compression spring and then slide forward to provide a secondary impact immediately after the primary impact caused when the main body of the hammer strikes the target object.

In some embodiments the sliding weight will be near the forward end of a hammer head, while in other embodiments the sliding weight will be at the back end. Also, in some embodiments a nail-removing claw will be located behind the guideway supporting the sliding weight. In still other embodiments the impact device may have two striking surfaces on opposite sides of the sliding weight so the device can be swung in two different directions in order to be used in two different modes. In particular, if the impact device employs a compression spring the device can be used where the secondary impact is applied either in a first mode directly or in a second indirect mode through the compression spring.

In other embodiments the reciprocating weight mechanism is adjustable. For example, the length of travel of a reciprocating weight can be adjusted by adjusting the exposed length of a shaft that supports the reciprocating weight. Alternatively, the position of an outer stop on a shaft supporting the weight can be adjusted. In still other embodiments, the impact device can be provided with a variety of replaceable springs and support shafts to allow alteration of the characteristics of the weight mechanism.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
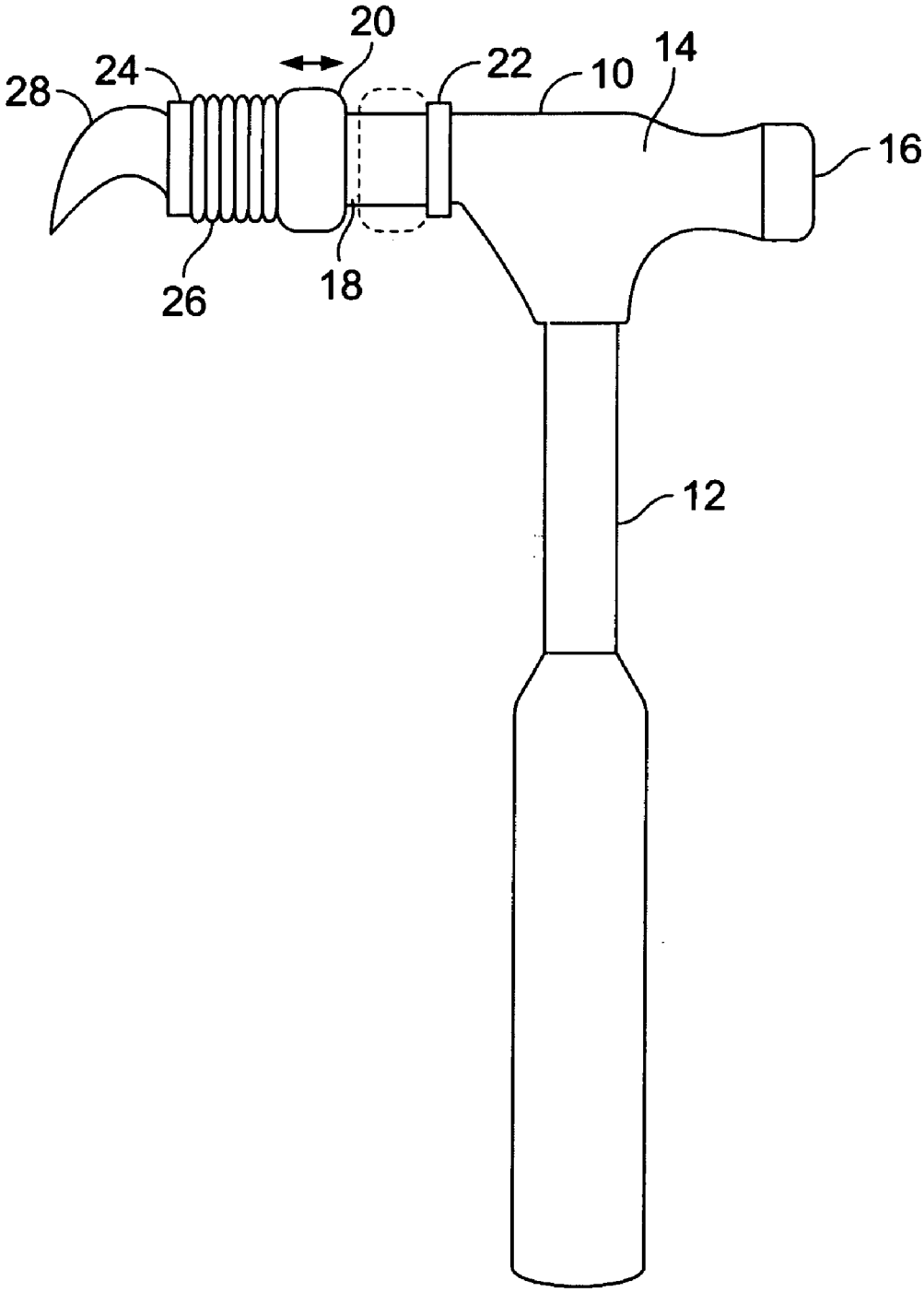
FIG. 1 is side view of an impact device in accordance with principles of the present invention.
Figure 2:
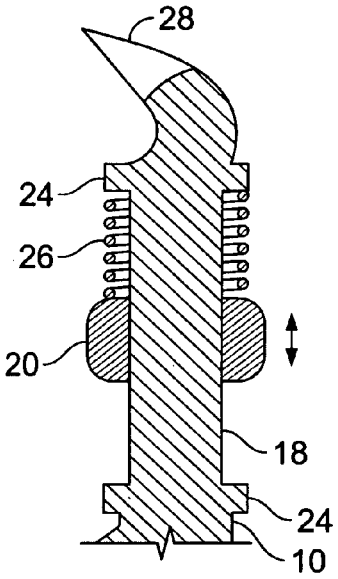
FIG. 2 is a longitudinal sectional view of a fragment of the device of FIG. 1 that supports the moveable weight.

Referring to FIGS. 1 and 2, the illustrated impact device has a hammer head 10, also referred to as an impact head. A handle 12 is attached below impact head 10 in alignment with the central region 14 of head 10. The forward end of impact head 10 is formed into a primary outer striker 16 having a shape similar to those found in conventional hammers. Extending backwardly from central region 14 is a shaft 18 acting as a guideway for weight 20. Weight 20 is a metal annulus having a weight of between 5 to 250 grams, although the actual weight will be chosen depending upon the impact desired when following the motions described hereinafter.

Guideway 18 may be a cylindrical shaft having a length of between 1.5 to 6.0 inches (3.8 to 15.2 cm), although the actual length will be chosen depending upon the desired characteristics and timing of the secondary impact to be described presently. The forward end of guideway 18 has a flanged stop 22 acting as an impact surface for weight 20. The aft end of guideway 18 has a flanged stop 24.

A helical compression spring 26 is mounted between stop 24 and weight 20 to act as a yielding member against which weight 20 can recoil or rebound. Accordingly, weight 20 is free to move in a straight path between a first position where spring 26 is fully or partially compressed to a second position against stop 22. When uncompressed, spring 26 preferably occupies 20% to 60% of the length of guideway 18. Also, spring 26 preferably has a spring constant and overall configuration that permits about 2% to 30% compression of the spring when weight 20 rests statically against the spring with guideway 18 vertical. Alternatively, spring 26 may be configured to compress about 50% to 95% when the user rhythmically swings the device when, for example, driving a nail. Accordingly, spring 26 will be tailored to accommodate the vigor and rhythm of individual users.

A bifurcated structure 28 projecting backwardly behind stop 24 acts as a nail-removing claw and has a configuration similar to that found on conventional claw hammers.

Figure 3:
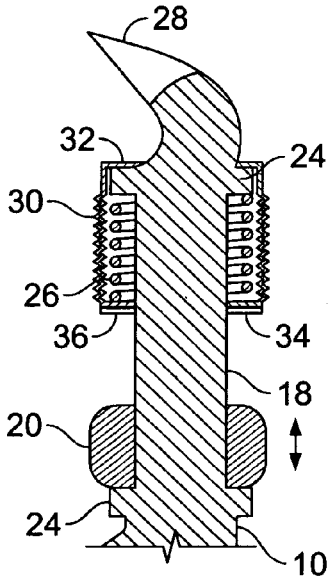
FIG. 3 is a longitudinal sectional view of the fragment of FIG. 2 fitted with a spring cover, and with its moveable weight repositioned.

Referring to FIG. 3, the device of FIG. 2 is fitted with a flexible sleeve 30 shown herein as an elastomeric bellows having an outer lip 32 designed to fit around stop 24 and an inner lip 34 designed to fit between spring 26 and a thrust washer 36.

Figure 4:
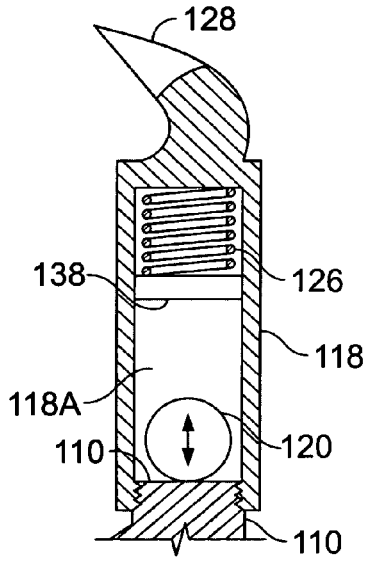
FIG. 4 is a longitudinal sectional view of a fragment of a device that is an alternate to that of FIG. 3.

Referring to FIG. 4, the illustrated, modified guideway is an alternative that shown in FIG. 2. Components corresponding to those previously illustrated in FIGS. 1 and 2 bear the same reference numeral but increased by 100. Instead of a shaft-type guideway, impact head 110 has a tubular guideway 118 threaded onto threaded stub 110A. Mounted in the distal end of the tunnel 118A of guideway 118 is a helical compression spring 126. A spherical weight 120 is mounted in the proximal end of tunnel 118A. A thrust disk 138 is slidably mounted between spring 126 and weight 120. Similar to the previous embodiment, the end of guideway 118 is fitted with nail-removing claw 128.

Figure 5:
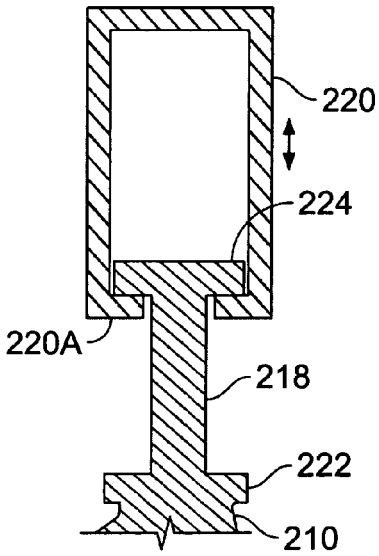
FIG. 5 is a longitudinal sectional view of a fragment of a device that is an alternate to that of FIGS. 3 and 4.

Referring to the illustrated, modified impact device of FIG. 5, components corresponding to those previously illustrated in FIGS. 1 and 2 bear the same reference numerals but increased by 200. Specifically, impact head 210 has a modified guideway shaft 218, bordered on its forward end by flange 224 and its aft end with a flange 224. A cup-shaped weight 220 is slidably mounted on shaft 218. Weight 220 has a proximal lip 220A that engages flange 224 and captures weight 220 on shaft 218.

Figure 6:
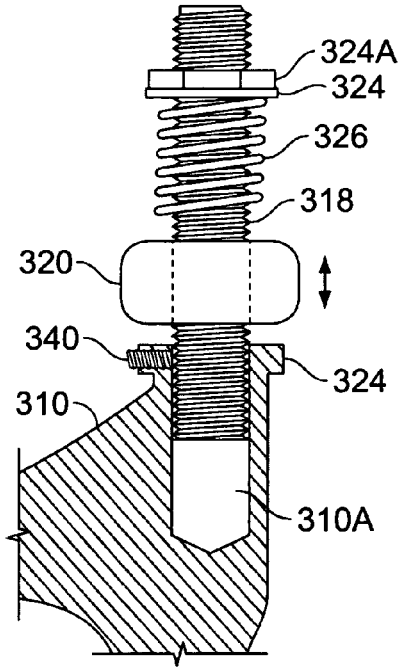
FIG. 6 is a longitudinal sectional view of a fragment of a device that is an alternate to that of FIGS. 3–5.

Referring to the illustrated, modified impact device of FIG. 6, components corresponding to those previously illustrated in FIGS. 1 and 2 bear the same reference numerals but increased by 300. Specifically, guideway 318 is fitted into the bore 310A of impact head 310. The depth of insertion of guideway 318 is maintained by screwing set screw 340 in flange 324 against guideway 318. In some embodiments, guideway 318 may be a threaded shaft that is screwed into bore 310A, which would then be threaded as well.

The distal end of guideway shaft 318 is fitted with a stop 324. While this stop could be an integral terminal flange, in this embodiment stop 324 is a thrust washer backed by a hex nut 324A. Much like before, an annular weight 320 is slidably mounted on guideway shaft 318. A helical compression spring 326 is mounted between weight 320 and stop 324.

In this arrangement the exposed length of guideway shaft 318 can be adjusted by changing its depth of insertion by using set screw 340. Also, guideway length can be adjusted by turning hex nut 324A to adjust the position of stop 324. Adjustments can also be made by replacing the guideway and therefore guideway 318 may be considered a substitute guideway in this embodiment. Also, hex nut 324A and thrust washer 324 may be temporarily removed so that spring 326 can be replaced to change the device's recoil or rebound characteristics.

Figure 7:
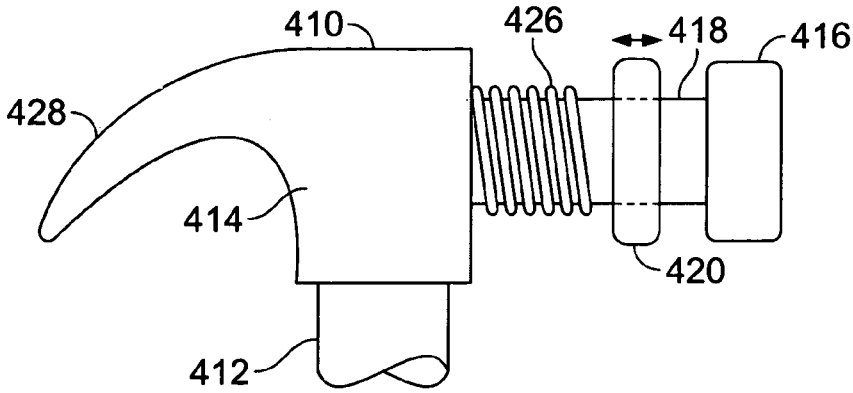
FIG. 7 is a detailed side view of an impact device that is an alternate to that shown in FIG. 1.

Referring to the illustrated, modified impact device of FIG. 7, components corresponding to those previously illustrated in FIGS. 1 and 2 bear the same reference numerals but increased by 400. A significant difference with this embodiment is the location of the annular weight 420 on the forward side of impact body device 410. On the other hand, the central portion 414 and claw 428 of impact device 410 are similar to the configuration found on conventional claw-type hammers. The forward end of impact device 410 has a guideway 418 in the form of a shaft on which annular weight 420 is slidably mounted between helical compression spring 426 and primary outer striker 416.

Figure 8:
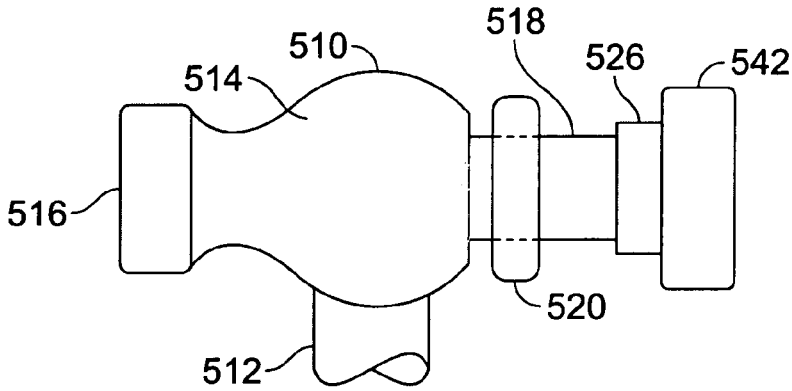
FIG. 8 is a detailed side view of an impact device that is an alternate to that shown in FIG. 1.

Referring to the illustrated, modified impact device of FIG. 8, components corresponding to those previously illustrated in FIGS. 1 and 2 bear the same reference numerals but increased by 500. In this embodiment impact device 510 has two striking surfaces: primary outer striker 516 and secondary outer striker 542. Guideway 518 is located between secondary outer striker 542 and the central portion 514 of impact device 510. The previously mentioned helical spring has been replaced with an annular elastomeric element 526 that may be made of a rubber-like material, a foam, or a yielding plastic material.

It will be appreciated that the foregoing reciprocating weight technology can be employed in a number of environments where it is desirable to provide a strong thrust or impact. Such force may be useful with brooms, scrapers, pry bars, shingle-removing bars, etc.

Figure 9:
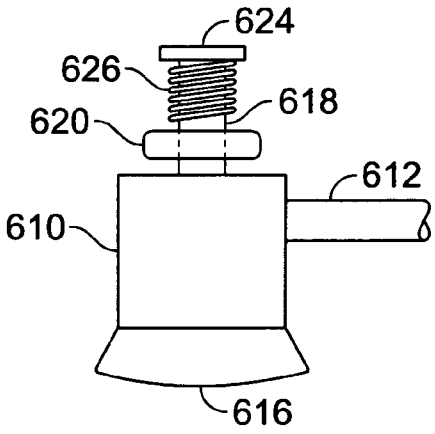
FIG. 9 is a detailed side view of an impact device that is an alternate to that shown in FIG. 1.

Referring to FIG. 9, the foregoing reciprocating weight technology is applied to an axe head 610 having a cutting-edge 616. As before, components corresponding to those previously illustrated in FIGS. 1 and 2 bear the same reference numerals but increased, now by 600. Specifically, a guideway shaft 618 extends backwardly from the aft end of ax head 610. Annular weight 620 is slidably mounted on guideway 618 next to helical compression spring 626, all of which are captured on guideway 618 by its outer stop 624.

Figure 10:
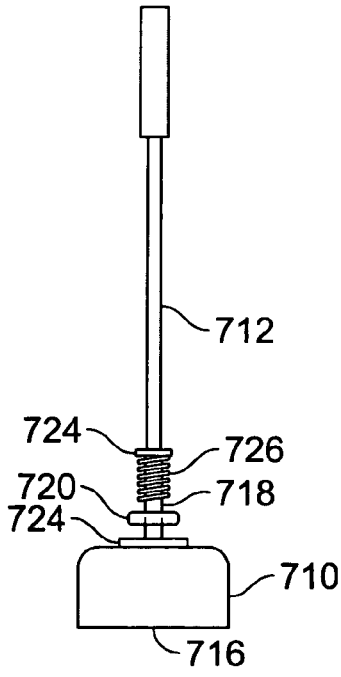
FIG. 10 is a detailed elevational view of an impact device that is an alternate to that shown in FIG. 1.

Referring to FIG. 10, the foregoing reciprocating weight technology is applied to an icebreaker. Once again, components corresponding to those previously illustrated in FIGS. 1 and 2 bear the same reference numerals but increased, now by 700. Unlike a hammer or an ax, handle 712 is in alignment with guideway 718 and may be a simple extension of the handle. In particular, guideway 718 is bordered on one side by flanged stop 724, and on the opposite side by stop plate 724. Annular weight 720 is slidably mounted on guideway 718. A helical compression spring 726 is mounted around guideway 718 between weight 720 and stop 724.

To facilitate an understanding of the principles associated with the foregoing apparatus, its operation will be briefly described. Referring to FIGS. 1 and 2, a user may grasp handle 12 in the usual fashion, swing device 10 back and then swing it forward so that striker 16 hits a target such as a nail. It is important to note that during the backswing weight 20 gathers kinetic energy while it stays against stop 22 and accelerates backwardly.

When device 10 reverses direction at the conclusion of the backswing, weight 20 will move from the second position shown in phantom in FIG. 1 to a first position bearing against spring 26. Depending upon the vigor of the backswing and forward swing, weight 20 will compress spring 26 accordingly. Compression of spring 26 will continue so long as device 10 is moving forward with significant acceleration. This acceleration may decline because of the user's swinging style or because the striker 16 hits its target, for example, a nail.

In any event, weight 20 will now be driven forward by the potential energy stored in spring 26, which will add to the momentum already achieved by the weight during the forward swing of device 10. Therefore, weight 20 will hit the impact surface provided by stop 22 to provide a secondary impulse that is conveyed through central region 14 to striker 16.

The user may now immediately swing the impact device 10 back to repeat the foregoing process. It will be appreciated that the user can develop a rhythm so that weight 20 effectively bounces rhythmically between its two extreme positions.

The foregoing device delivers more energy than a conventional hammer because the kinetic energy imparted to the weight 20 during the backswing is stored in the compression spring 26 and then later used to accelerate the weight and produce an enhanced secondary impact.

Also, a secondary impact can be beneficial for certain tasks. In particular, driving an implement into a relatively soft material involves not only breaking an opening for the implement, but overcoming viscous and frictional forces that slow the progress of the implement. These viscous or frictional forces can be overcome by effectively extending the time over which the driving forces occur by means of the rapidly following secondary impact described above.

It will be appreciated that the other embodiments operate in a substantially similar manner. In particular, ball 120 (FIG. 4) can rebound off spring 126 and then roll, slide or fly through tunnel 118A to create a secondary impact at stub 110. In addition, weight 420 (FIG. 7) will operate in a similar fashion, rebounding off spring 426 before providing a secondary impact on striker 416.

Referring to FIG. 8, when a blow is delivered by striker 516, this embodiment will operate in a similar fashion with weight 520 rebounding off of elastomeric member 526 before hitting impact device 510 to provide a secondary impact. The operation will be different, however, when a user strikes a blow using striker 542. In that case, weight 520 will tend to remain against the main body of device 510 during the forward swing (or depending on the dynamics, experience a hard bounce and achieve a relative forward motion).

When striker 542 hits its target, device 510 will rapidly decelerate and weight 520 will fly forward and impact elastomeric member 526. Because yielding member 526 is involved, the impulse delivered by weight 520 will be spread out over time, instead of being applied as a short-lived, sharp impulse. This spread-out impulse can be very effective in certain applications. Also, in some applications the user may not want to deliver a sharp blow. For example, when driving a nail into a finished wall in order to hang a picture, one does not want to accidentally drive the nail flush and it is therefore desirable to moderate the blows so that the depth of insertion of the nail can be carefully controlled.

It will be noted that a spring is not employed in every embodiment. In particular, the embodiment of FIG. 5 has no spring. Instead, weight 220 will extend during the forward swing to the position shown in FIG. 5. Upon impact, weight 220 will slide on guideway 218 until lip 220A impacts stop 222 to provide a secondary impact.

The operation of the icebreaker of FIG. 10 is essentially the same as described before, except that the user does not swing the device but thrusts it longitudinally.

It is appreciated that various modifications may be implemented with respect to the above described, preferred embodiments. In particular, the illustrated guideway can be made of metal, plastics, or other materials. Also the cross-section of the guideway can be circular, square, polygonal, oval, etc. In some embodiments the guideway may provide a curved path for the weight. While the motion of the weight is shown aligned with the striker, in other embodiments the path of the weight may be aligned differently. While the yielding members is shown mounted on the guideway, in other embodiments, the yielding member can be attached to the weight itself. Furthermore, the various shapes, dimensions and relative positions of illustrated components can be altered in other embodiments depending on the desired size, force, reliability, strength, etc.

Obviously, many modifications and variations of the present invention are possible in light of the above teachings. It is therefore to be understood that within the scope of the appended claims, the invention may be practiced otherwise than as specifically described.

What is claimed is:

1. An impact device comprising:

a handle;

an impact head attached to said handle and having a guideway, said head having a primary outer striker, said guideway having a shaft extending away from said primary outer striker;

a weight reciprocatably mounted on said head to move along said guideway between a first position and a second position in response to motion of said head, said weight comprising an annulus encircling and slidably mounted on said shaft; and a yielding member mounted at said guideway between said weight and said first position, said weight being operable to recoil against said yielding member.

2. An impact device according to claim 1 wherein said guideway provides said weight a straight path between said first and said second position.

3. An impact device according to claim 1 wherein said head has projecting therefrom a primary outer striker, said guideway having a shaft extending away from said primary outer striker, said weight being cup-shaped, said weight encircling and being slidably mounted on said shaft.

4. An impact device according to claim 1 wherein said second position is closer to said primary outer striker than said first position.

5. An impact device according to claim 4 wherein said impact head has at said second position an impact surface that said weight can impact.

6. An impact device according to claim 1 wherein said guideway has an adjustable length.

7. An impact device according to claim 1 wherein said guideway is replaceable with a substitute guideway having a different length.

8. An impact device according to claim 1 wherein said yielding member comprises a spring at said first position.

9. An impact device according to claim 1 wherein said impact head has said primary outer striker to one side of a central region, said guideway being between said primary outer striker and said central region.

10. An impact device according to claim 1 wherein said impact head has a tunnel, said weight being mounted to move in said tunnel.

11. An impact device according to claim 10 wherein said handle projects outwardly from said central region of said impact head.

12. An impact device according to claim 11 wherein said impact head is arranged as a hammer head with said handle projecting transversely.

13. An impact device according to claim 1 wherein said head has projecting therefrom a primary outer striker shaped as either an axe edge, an ice breaker edge, a shovel edge, or a scraper edge.

14. An impact device according to claim 1 wherein said yielding member comprises an elastomeric element.

15. An impact device according to claim 1 wherein said impact head is arranged as a hammer head with said handle projecting transversely.

16. An impact device according to claim 1 wherein said yielding member is replaceably mounted so that the recoil characteristics offered by said yielding member can be altered.

17. An impact device comprising:

a handle;

an impact head attached to said handle and having a guideway;

a weight reciprocatably mounted on said head to move along said guideway between a first position and a second position in response to motion of said head;

a yielding member mounted at said guideway, said weight being operable to recoil against said yielding member, said yielding member comprising a spring at said first position; and a flexible sleeve covering said spring.

18. An impact device according to claim 17 wherein said yielding member comprises an elastomeric element.

19. An impact device according to claim 17 wherein said head has a primary outer striker that is closer to said second position than said first position.

20. An impact device comprising:

a handle;

an impact head attached to said handle and having a guideway, said impact head having a primary outer striker to one side of a central region, said guideway and said primary outer striker being on opposite sides of said central region, said handle projecting outwardly from said central region of said impact head, said impact head being arranged as a hammer head with said handle projecting transversely, said impact head having a secondary outer striker, said primary outer striker and said secondary outer striker being on opposite sides of said central region, so that said impact head can be swung in opposite directions to strike an object with either said primary or said secondary outer striker; and a weight reciprocatably mounted on said head to move along said guideway between a first position and a second position in response to motion of said head.

21. An impact device according to claim 20 comprising:

a yielding member mounted at said guideway, said weight being operable to recoil against said yielding member upon said secondary outer striker hitting an object, said weight being operable to move away from said yielding member upon said primary outer striker hitting an object.

22. An impact device comprising:

a handle;

an impact head attached to said handle and having a guideway, said impact head having a primary outer striker to one side of a central region, said guideway and said primary outer striker being on opposite sides of said central region said handle projecting outwardly from said central region of said impact head, said impact head being arranged as a hammer head with said handle projecting transversely;

a weight reciprocatably mounted on said head to move along said guideway between a first position and a second position in response to motion of said head; and a yielding member mounted at said guideway, said weight being operable to recoil against said yielding member.

23. An impact device according to claim 22 wherein said head has a primary outer striker, said guideway having a shaft extending away from said primary outer striker, said weight being cup-shaped, said weight encircling and being slidably mounted on said shaft.

24. An impact device according to claim 22 wherein said guideway has an adjustable length.

25. An impact device according to claim 22 wherein said guideway is replaceable with a substitute guideway having a different length.

26. An impact device according to claim 22 wherein said weight is operable to recoil against said yielding member upon said secondary outer striker hitting an object, said yielding member being replaceably mounted so that the recoil characteristics offered by said yielding member can be altered.

27. An impact device according to claim 22 wherein said impact head has a tunnel, said weight being mounted to move in said tunnel.

28. An impact device according to claim 22 comprising:

a flexible sleeve covering said spring.

29. An impact device comprising:

a handle;

an impact head attached to said handle and having a guideway, said impact head having a primary outer striker to one side of a central region, said guideway and said primary outer striker being on opposite sides of said central region, said handle projecting outwardly from said central region of said impact head, said impact head being arranged as a hammer head with said handle projecting transversely, said impact head having a nail removing claw, said primary outer striker and said claw being on opposite sides of said central region; and a weight reciprocatably mounted on said head to move along said guideway between a first position and a second position in response to motion of said head.

30. An impact device according to claim 29 wherein said impact head has a tunnel, said weight being mounted to move in said tunnel.

31. An impact device according to claim 30 wherein said weight is round and rolls in said tunnel.

* * * * *